US005370780A

United States Patent [19]

Meissner

[11] Patent Number: 5,370,780

[45] Date of Patent: Dec. 6, 1994

[54] DEVICE FOR CONTINUOUS ELECTRODELESS ELECTROCHEMICAL TREATING OF AN ELECTRICALLY CONDUCTIVE WEB IN AN ELECTROLYTE CELL

[75] Inventor: Manfred Meissner, Berlin, Germany

[73] Assignee: Sun Chemical Corporation, Fort Lee, N.J.

[21] Appl. No.: 107,817

[22] PCT Filed: Mar. 3, 1992

[86] PCT No.: PCT/EP92/00462

§ 371 Date: Aug. 18, 1993

§ 102(e) Date: Aug. 18, 1993

[87] PCT Pub. No.: WO92/15728

PCT Pub. Date: Sep. 17, 1992

[30] Foreign Application Priority Data

Mar. 4, 1991 [DE] Germany ..... 4106829

[51] Int. Cl.[5] ..... C25D 17/00

[52] U.S. Cl. ..... 204/206; 204/DIG. 5

[58] Field of Search ..... 204/206, 211, DIG. 5

[56] References Cited

U.S. PATENT DOCUMENTS

| | | | |
|---|---|---|---|
| 2,541,275 | 2/1951 | Odier | 204/211 |
| 3,697,399 | 10/1972 | Usui | 204/206 X |
| 3,935,080 | 1/1976 | Gumbinner | 204/28 |
| 4,177,127 | 12/1979 | Severus-Laubenfeld | 204/206 X |
| 4,240,881 | 12/1980 | Stanya | 204/211 X |
| 5,271,818 | 12/1993 | Stroszynski et al. | 204/211 |

FOREIGN PATENT DOCUMENTS

| | | |
|---|---|---|
| 684267 | 11/1939 | Germany . |
| 729701 | 11/1942 | Germany . |

*Primary Examiner*—Donald R. Valentine
*Attorney, Agent, or Firm*—Jack Matalon

[57] ABSTRACT

A device for continuous electrochemical treating of an electrically conductive web in an electrolyte cell is provided. The invention permits an electrodeless treatment of wide webs with high uniformity and low power consumption without additional electrodes, bars or cables and conductive means.

4 Claims, 2 Drawing Sheets

DEVICE FOR CONTINUOUS ELECTRODELESS ELECTROCHEMICAL TREATING OF AN ELECTRICALLY CONDUCTIVE WEB IN AN ELECTROLYTE CELL

This invention relates to a device for continuous electrodeless electrochemical treating of an electrically conductive web in an electrolyte cell, in particular for anodizing or graining of an aluminium web. The anodizing or graining of aluminium webs is used in the production of offset printing plates. In this connection, treating of relatively wide webs with high accuracy is necessary.

A method for producing an aluminium base sheet for,printing plates by graining and anodizing in an electrolyte cell is known from the U.S. Pat. No. 3,935,080 (Gumbinner et al.). Thereby, an aluminium web is moved through several treating baths. Electrodes are placed in confrontation with the wet causing anodizing or graining of the web. The current applied to the electrodes can be an alternating or direct: current. This method allows the treating of wide webs, however the use of electrodes and high current conductors requires additional investment costs and power consumption compared with this invention. The higher power consumption of the conventional process is caused by a voltage-drop in the conductors and the electrolyte and the excess voltage at the electrodes; in contrast, the present invention allows a two-fold treatment of the web surface with the same cell length.

The German Patent 684,267 (Rummel et al.) discloses an electrodeless method for the electrolytical treatment of an electrically conductive wire or web moved through an electrolyte cell, wherein a current is generated by induction in the wire or web. The electrolysis takes place between portions of different potentials of the wire or web. In this case, the wire or web is passed through the transformer core several times and constitutes the secondary coil; this excludes the use of wide webs.

The object of this invention is to provide a device for continuous electrodeless electrochemical treating of wide webs as well.

This object is solved with the features of the claims.

The advantages of the invention are that no electrodes, bars or cables carrying high current and no contact cells or contact rollers for the web are necessary. The invention reduces investment costs, power consumption and requires less space.

Nowadays, high current transformers are available which are capable of inducing sufficient voltage for the electrolysis to one single secondary turn at feasible dimensions. Such a transformer is used in this invention.

The invention will now be described with reference to the accompanying drawings.

Figure 1:
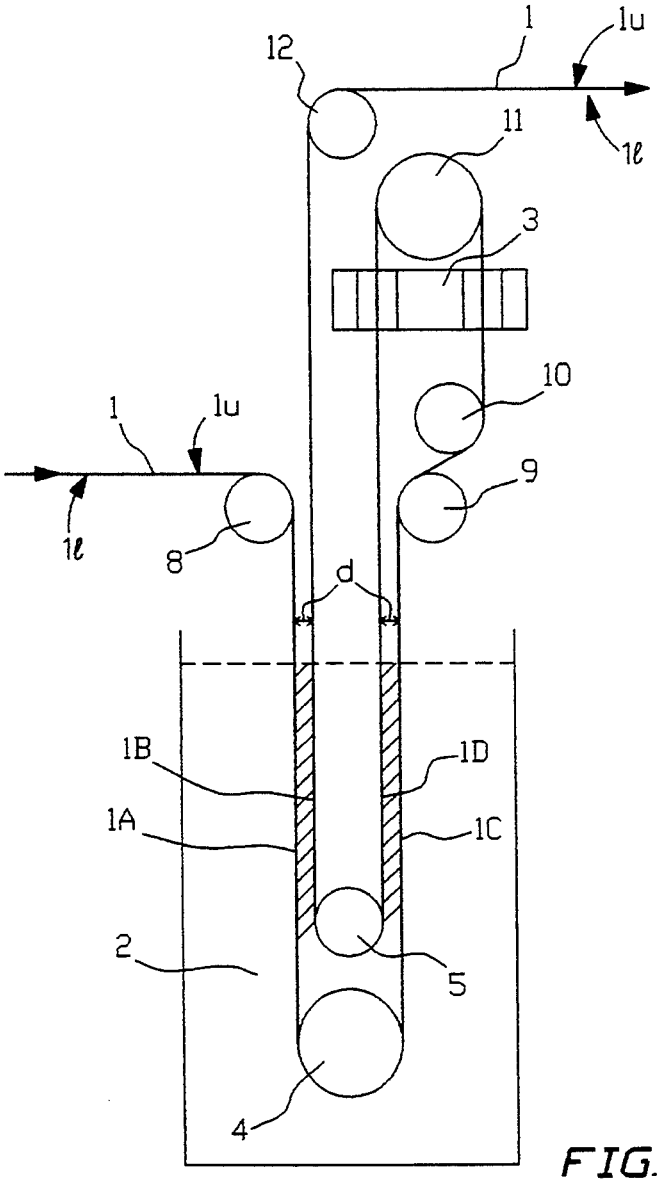
FIG. 1 shows a schematic side view of an apparatus according to a first embodiment of the invention.

According to FIG. 1, an electrically conductive web 1, e.g. an aluminium web, is transported over a roller 8 vertically into an electrolyte cell 2. A first roller 4 turns the web 1 again to the top of the electrolyte cell 2. Then the web 1 is transported over several turning rollers 9 to 11 to the transformer 3 wherein a current is induced in the web 1. This current flow leads to potential differences over the length of the web 1. Then, the web 1 is again transported vertically downwards into the electrolyte cell 2, is turned by a second roller 5 and is transported vertically to the top of the electrolyte cell over the roller 12. The roller 5 is located vertically above the first roller 4 and has a smaller diameter than the roller 4. Therefore, there is a constant distance d between the two portions 1A and 1B and between the two portions 1C and 1D of the web 1 being transported through the electrolyte cell. In this way, the potential difference of the web before and after passing through the transformer gives rise to an uniform electrochemical treatment, e.g. anodizing or graining of the web which takes place in the hatched areas.

Also, the passage for the web 1 in the transformer 3 is constructed to allow the passing of a relatively wide web 1, e.g. up to a width of 160 cm.

Figure 2:
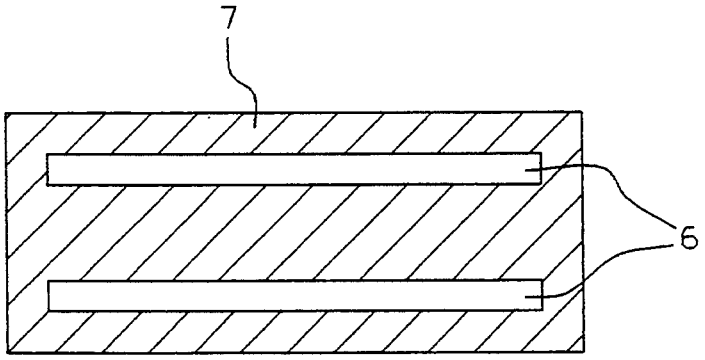
FIG. 2 shows a top view of the transformer core.

FIG. 2 shows slots 6 in the transformer core 7 for the passing of the web 1 through the magnetic field of the transformer 3. A single slot or more than two slots are also possible according to the invention.

Figure 3:
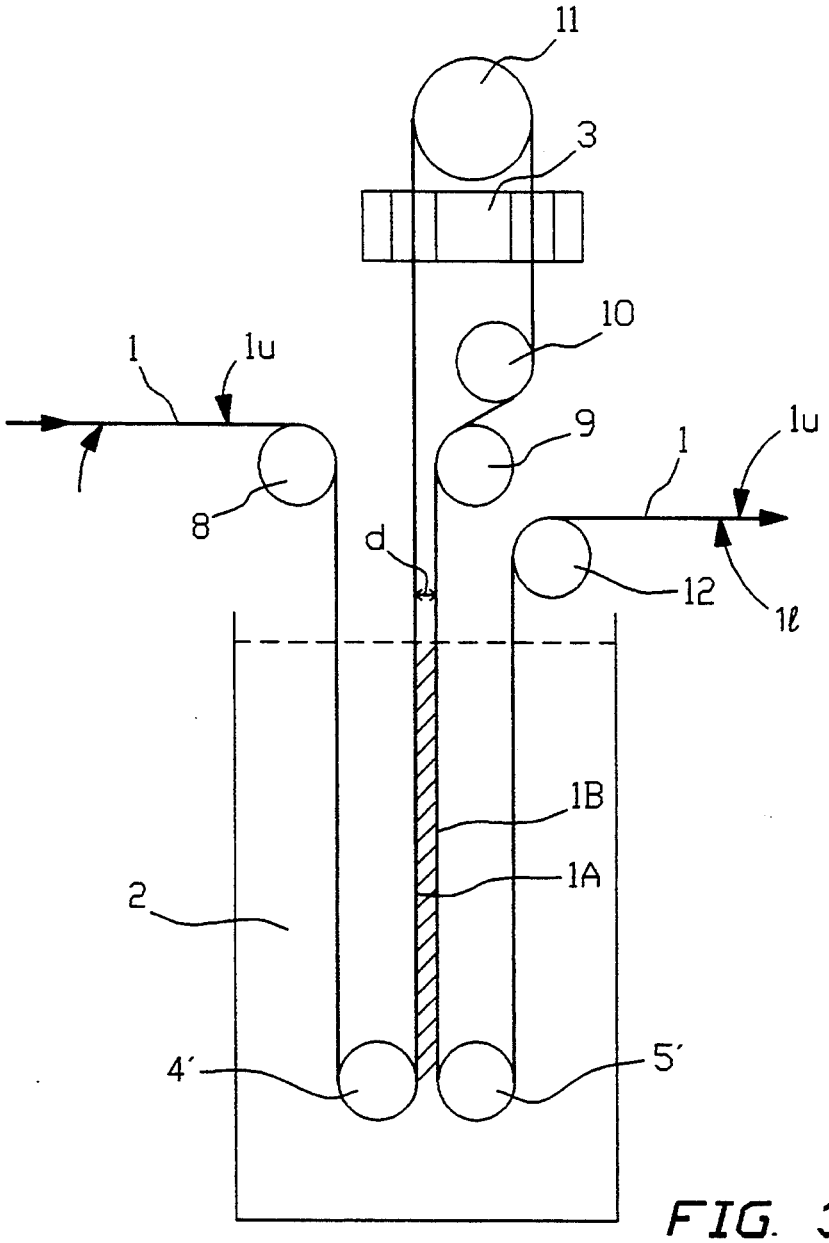
FIG. 3 shows a schematic side view according to a second embodiment of the invention.

With the embodiment of FIG. 1, the upper web surface 1*u* can be treated (the upper web surface 1*u* is defined with respect to the horizontal path upstream of the roller 8 and downstream of the roller 12 in FIGS. 1 and 3).

The electrochemical treating of the lower web surface 11 is performed by a second embodiment as shown in FIG. 3. The web 1 is then transported over two horizontally arranged rollers 4' and 5'. The transporting over the rollers 8 to 12 corresponds to the embodiment of FIG. 1. The web 1 is transported over the first roller 4' before passing through the transformer 3 and over the second roller 5' after passing through the transformer 3. Between the two rollers 4', 5' and the top of the electrolyte cell 2 are two portions 1A and 1B of the web 1 with different potentials and a constant distance d between each other. In this way, a uniform electrochemical treatment of the lower web side 11 is achieved in the hatched area.

For treating said two web surfaces 1*u* and 1*l*, the first and the second embodiment according to the invention should be arranged subsequently.

In the above-mentioned embodiments, a constant distance between the portions 1A–1D of the web is realized by transporting the web along parallel straight lines, but a transport along curved lines with a constant distance is also possible.

I claim:

1. In a device for the continuous electrochemical treatment of an electrically conductive web with an electrolyte cell, a transformer having a magnetic field and means for transporting the electrically conductive web through the electrolyte cell and the magnetic field, wherein a current is generated by the transformer on the surface of the web and at least two portions of the web with different potentials are spaced apart from each other in the electrolyte cell, the improvement which comprises providing a transformer having a core and at least one slot in the core, thereby allowing the passage of wide webs, said portions of the web being spaced apart from each other by subsequently transporting the web over a first and second roller in the electrolyte cell before and after passing through the transformer, respectively, the second roller being arranged above the first roller and the diameter of the first roller being greater than that of the second roller.

2. The device of claim 1 wherein the transformer is located outside of the electrolyte cell.

3. The device of claim 1 wherein the distance between said portions of the web is constant.

4. The device of claim 1 wherein the second roller is arranged horizontally adjacent to the first roller.

* * * * *